US009318052B2

(12) United States Patent
Choo et al.

(10) Patent No.: US 9,318,052 B2
(45) Date of Patent: Apr. 19, 2016

(54) COMPENSATING ORGANIC LIGHT EMITTING DIODE DISPLAY DEVICE AND METHOD FOR DRIVING THE SAME USING TWO ADJACENT GATE LINES PER PIXEL

(71) Applicant: LG Display Co., Ltd., Seoul (KR)

(72) Inventors: Kyo-Seop Choo, Suwon-si (KR); Hwa-Dong Han, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 7 days.

(21) Appl. No.: 14/133,101

(22) Filed: Dec. 18, 2013

(65) Prior Publication Data

US 2015/0002501 A1 Jan. 1, 2015

(30) Foreign Application Priority Data

Jun. 28, 2013 (KR) ..... 10-2013-0076025

(51) Int. Cl.
*G09G 3/32* (2006.01)

(52) U.S. Cl.
CPC ..... *G09G 3/3258* (2013.01); *G09G 2300/0465* (2013.01)

(58) Field of Classification Search
CPC .... G09G 3/003; G09G 3/3233; G09G 3/3674
See application file for complete search history.

(56) References Cited

U.S. PATENT DOCUMENTS

2004/0100203 A1* 5/2004 Kobayashi et al. ..... 315/169.3
2012/0050274 A1* 3/2012 Yoo et al. ..... 345/419

FOREIGN PATENT DOCUMENTS

CN 100573282 C 12/2009
CN 103050085 A 4/2013
CN 103106868 A 5/2013

* cited by examiner

*Primary Examiner* — Dwayne Bost
*Assistant Examiner* — Sepehr Azari
(74) *Attorney, Agent, or Firm* — Dentons US LLP

(57) ABSTRACT

Disclosed is an organic light emitting diode display device and a method for driving the same. The device includes a display panel having a plurality of sub-pixels wherein the sub-pixels formed on each horizontal line are connected to a gate line on the same horizontal line and are further connected to a gate line on a next horizontal line to further receive a gate on signal from the gate line on the next horizontal line so as to display an image, a power supply supplying first and second power signals to power lines of the display panel and supplying a compensation voltage to a compensation power line, and a timing controller for arranging external input video data suitably for driving of the display panel and controlling gate and data drivers such that the image is displayed based on a data voltage compensated for by the compensation voltage.

8 Claims, 3 Drawing Sheets

COMPENSATING ORGANIC LIGHT EMITTING DIODE DISPLAY DEVICE AND METHOD FOR DRIVING THE SAME USING TWO ADJACENT GATE LINES PER PIXEL

CROSS-REFERENCE TO RELATED APPLICATIONS

This application claims the benefit of Korean Patent Application No. 10-2013-0076025, filed on Jun. 28, 2013 which is hereby incorporated by reference for all purposes as if fully set forth herein.

BACKGROUND OF THE INVENTION

1. Field of the Invention

The present invention relates to an organic light emitting diode (OLED) display device. More particularly, the present invention relates to an OLED display device which is capable of not only compensating for a video voltage charged in each sub-pixel, but also simplifying a pixel circuit structure and a wiring structure and raising an aperture ratio, so as to further enhance picture quality, and a method for driving the same.

2. Discussion of the Related Art

Recently, a liquid crystal display, a field emission display, a plasma display panel and an organic light emitting diode (OLED) display have been highlighted as flat panel displays. Thereamong, the OLED display is a self-emissive device in which an organic light emitting layer emits light by recombination of electrons and holes, and is expected to be a next-generation display device owing to high luminance, low driving voltage and ultra-thinness thereof.

Such an OLED display device includes a plurality of sub-pixels, each of which includes an OLED having an organic light emitting layer disposed between an anode and a cathode, and a pixel circuit for independently driving the OLED.

The pixel circuit includes a plurality of switching transistors, at least one capacitor, and a driving transistor. The switching transistors charge a data signal in the capacitor in response to a scan signal generated in every horizontal period. The driving transistor controls the amount of current to be supplied to the OLED in response to a separate sense signal such that it corresponds to the level of a video voltage charged in the capacitor, thereby adjusting the gray scale of a corresponding sub-pixel.

A conventional pixel circuit configured in this manner should receive a scan signal and a sense signal that overlap during a certain period, respectively, through a plurality of gate lines to sequentially drive a plurality of switching transistors and a driving transistor. For this reason, a plurality of gate lines should be provided on a horizontal line basis to transmit a scan signal and a sense signal, respectively. This may result in a reduction in aperture ratio of each sub-pixel.

SUMMARY OF THE INVENTION

Accordingly, the present invention is directed to an organic light emitting diode display device and a method for driving the same that substantially obviate one or more problems due to limitations and disadvantages of the related art.

An object of the present invention is to provide an organic light emitting diode display device which is capable of not only compensating for a video voltage charged in each sub-pixel, but also simplifying a pixel circuit structure and a wiring structure and raising an aperture ratio, so as to further enhance picture quality, and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes a display panel having a plurality of sub-pixels formed in such a manner that sub-pixels on each horizontal line are connected to a gate line on the same horizontal line and are further connected to a gate line on a next horizontal line to further receive a gate on signal from the gate line on the next horizontal line so as to display an image, a gate driver for driving the gate lines of the display panel, a data driver for driving data lines of the display panel, a power supply for supplying first and second power signals to power lines of the display panel and supplying a compensation voltage to a compensation power line of the display panel, and a timing controller for arranging external input video data suitably for driving of the display panel and supplying the arranged video data to the data driver, and controlling the gate and data drivers such that the image is displayed based on a data voltage compensated for by the compensation voltage.

Each of the plurality of sub-pixels may include a first switching element for supplying a data signal from a corresponding one of the data lines to a first node in response to a gate on signal from the gate line on the same horizontal line to charge a storage capacitor, a second switching element for supplying the compensation voltage supplied through the compensation power line to a second node in response to the gate on signal from the gate line on the next horizontal line, and a driving switching element for controlling the amount of current flowing to an organic light emitting diode in response to a voltage on the first node, the organic light emitting diode being connected to the second node, the voltage on the first node varying with charge/discharge of the storage capacitor, wherein the storage capacitor may be connected between the first node and the second node in parallel with the driving switching element to store a difference voltage between the first and second nodes and maintain a turned-on state of the driving switching element using the stored voltage when the first switching element is turned off The gate driver may drive gate lines of a number greater by one than a total number of horizontal lines, a last one of the gate lines being driven in the same period as a first one of the gate lines.

The gate driver may supply a gate on signal of two horizontal periods to each of the gate lines on a horizontal period basis in such a manner that a gate on signal to a gate line on a current horizontal line overlaps with a gate on signal to a gate line on a subsequent horizontal line by one horizontal period.

The first switching element may be turned on for two horizontal periods to supply a data voltage from the corresponding data line to the first node and the storage capacitor in a data input period which is one horizontal period, the second switching element may be turned on for two horizontal periods by a gate on voltage from the gate line on the next horizontal line to supply the compensation voltage to the second node, and the first and second switching elements may be both turned off in a light emission period to keep a voltage across the storage capacitor constant and, in turn, to keep a voltage variation at the first node constant to keep the driving switching element on so as to turn on the organic light emitting diode.

In another aspect of the present invention, a method for driving an organic light emitting diode display device, which includes a display panel having a plurality of sub-pixels formed in such a manner that sub-pixels on each horizontal line are connected to a gate line on the same horizontal line and are further connected to a gate line on a next horizontal line to further receive a gate on signal from the gate line on the next horizontal line so as to display an image, includes driving the gate lines of the display panel, driving data lines of the display panel, supplying first and second power signals to power lines of the display panel and supplying a compensation voltage to a compensation power line of the display panel, and arranging external input video data suitably for driving of the display panel and controlling gate and data drivers such that the image is displayed based on a data voltage compensated for by the compensation voltage.

Each of the plurality of sub-pixels may include a first switching element for supplying a data signal from a corresponding one of the data lines to a first node in response to a gate on signal from the gate line on the same horizontal line to charge a storage capacitor, a second switching element for supplying the compensation voltage supplied through the compensation power line to a second node in response to the gate on signal from the gate line on the next horizontal line, and a driving switching element for controlling the amount of current flowing to an organic light emitting diode in response to a voltage on the first node, the organic light emitting diode being connected to the second node, the voltage on the first node varying with charge/discharge of the storage capacitor, wherein the storage capacitor may be connected between the first node and the second node in parallel with the driving switching element to store a difference voltage between the first and second nodes and maintain a turned-on state of the driving switching element using the stored voltage when the first switching element is turned off The driving the gate lines may include driving gate lines of a number greater by one than a total number of horizontal lines, a last one of the gate lines being driven in the same period as a first one of the gate lines.

The driving the gate lines may include supplying a gate on signal of two horizontal periods to each of the gate lines on a horizontal period basis in such a manner that a gate on signal to a gate line on a current horizontal line overlaps with a gate on signal to a gate line on a subsequent horizontal line by one horizontal period.

The first switching element may be turned on for two horizontal periods to supply a data voltage from the corresponding data line to the first node and the storage capacitor in a data input period which is one horizontal period, the second switching element may be turned on for two horizontal periods by a gate on voltage from the gate line on the next horizontal line to supply the compensation voltage to the second node, and the first and second switching elements may be both turned off in a light emission period to keep a voltage across the storage capacitor constant and, in turn, to keep a voltage variation at the first node constant to keep the driving switching element on so as to turn on the organic light emitting diode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
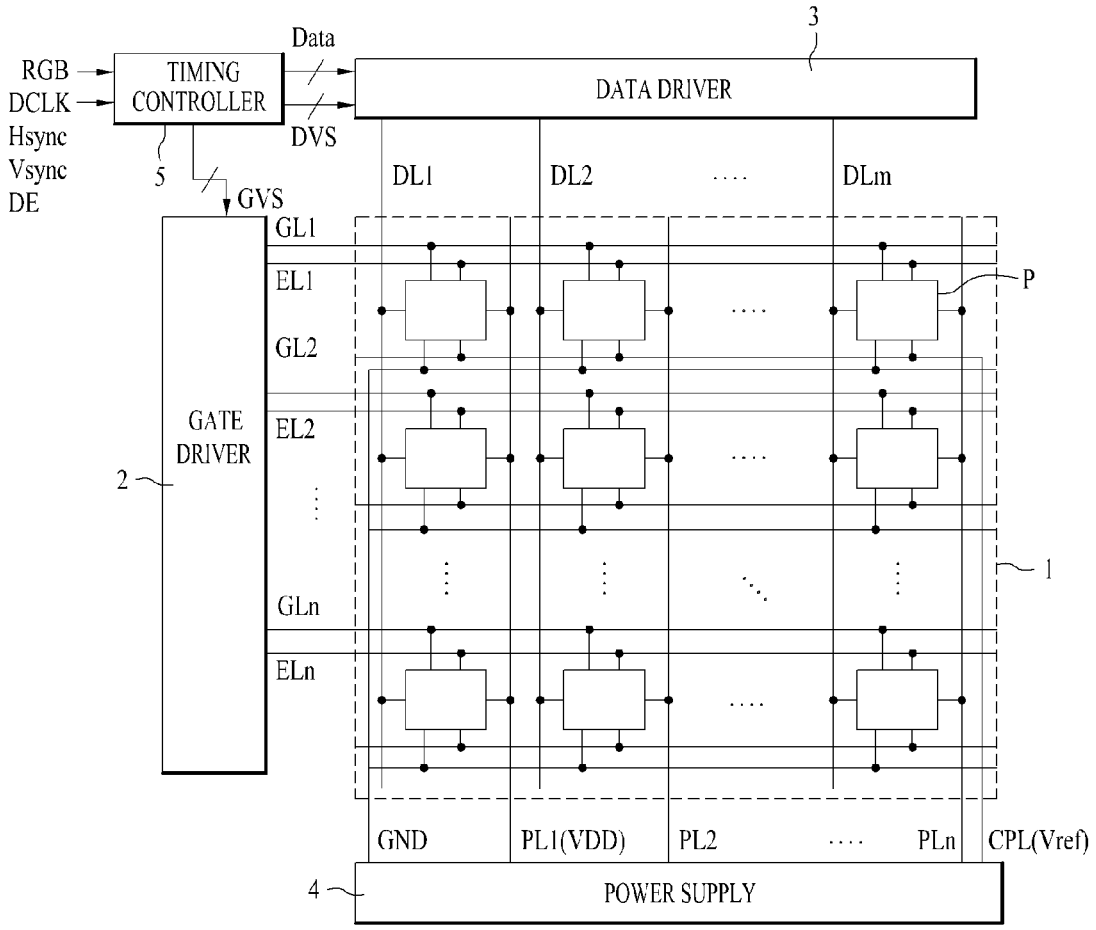
FIG. 1 is a block diagram showing the configuration of an organic light emitting diode display device according to an embodiment of the present invention.
Figure 2:
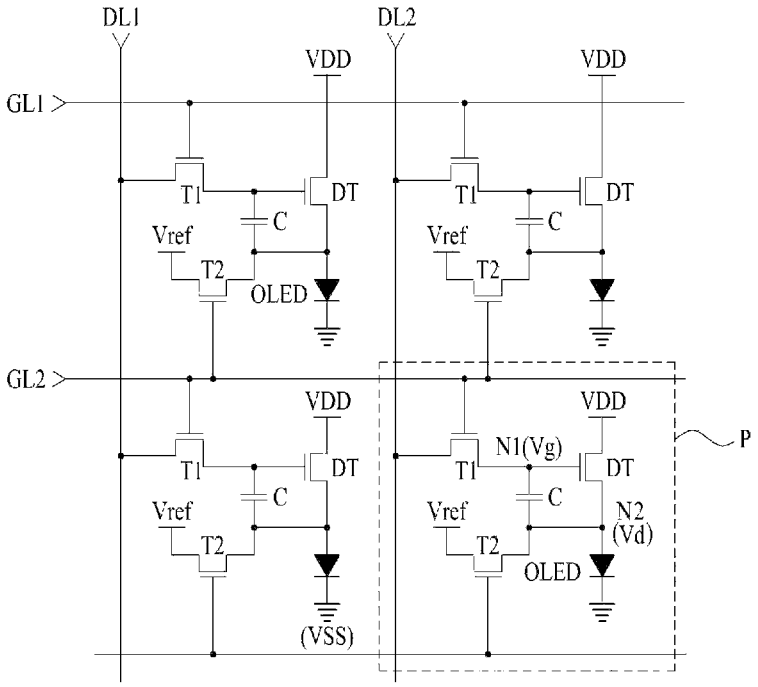
FIG. 2 is an equivalent circuit diagram of 2×2 sub-pixels of a display panel shown in FIG. 1.

FIG. 1 is a block diagram showing the configuration of an organic light emitting diode display device according to an embodiment of the present invention, and FIG. 2 is an equivalent circuit diagram of 2×2 sub-pixels of a display panel shown in FIG. 1.

The organic light emitting diode (OLED) display device shown in FIG. 1 includes a display panel 1 having a plurality of sub-pixels P formed in such a manner that sub-pixels on each horizontal line are connected to a gate line GL1 to GLn on the same horizontal line and are further connected to a gate line GL2 to GLn+1 on a next horizontal line to further receive a gate on signal from the gate line GL2 to GLn+1 on the next horizontal line so as to display an image. The OLED display device further includes a gate driver 2 for driving the gate lines GL1 to GLn+1 of the display panel 1, a data driver 3 for driving data lines DL1 to DLm of the display panel 1, a power supply 4 for supplying first and second power signals VDD and VSS to power lines PL1 to PLm of the display panel 1 and supplying a compensation voltage Vref to a compensation power line CPL of the display panel 1, and a timing controller 5 for arranging external input video data suitably for driving of the display panel 1 and supplying the arranged video data to the data driver 3, and controlling the gate and data drivers 2 and 3 such that the image is displayed based on a data voltage compensated for by the compensation voltage Vref.

In the display panel 1, the sub-pixels P are arranged in respective pixel areas in matrix form to display an image. Each of the sub-pixels P includes an OLED, and a pixel circuit for independently driving the OLED. In detail, each sub-pixel P includes a pixel circuit connected to a corresponding gate line GL2, a corresponding data line DL2 and a high-voltage power line PL VDD, and an OLED connected between the pixel circuit and a low voltage source VSS, as shown in FIG. 2.

In the sub-pixels P, sub-pixels on every horizontal line are configured in such a manner that pixel circuits thereof are connected to the gate line GL1 to GLn on the same horizontal line and are further connected to the gate line GL2 to GLn+1 on the next horizontal line. As a result, the pixel circuit of each sub-pixel P receives a gate on signal from the gate line GL1 to GLn on the same horizontal line and further receives a gate on signal from the gate line GL2 to GLn+1 on the next horizontal line.

Each pixel circuit includes first and second switching elements T1 and T2, a driving switching element DT, and a storage capacitor C. Here, the first and second switching elements T1 and T2 and the driving switching element DT may be composed of NMOS transistors or PMOS transistors. The following description will be given on the assumption that the first and second switching elements T1 and T2 and the driving switching element DT are composed of PMOS transistors.

The first switching element T1 supplies a data signal from the data line DL1 to a first node N1 in response to the gate on signal from the gate line GL1 on the same horizontal line to charge the storage capacitor C.

The second switching element T2 supplies the compensation voltage Vref supplied through the compensation power line CPL to a second node N2 to which the OLED is connected, in response to the gate on signal from the gate line GL2 on the next horizontal line.

The driving switching element DT controls the amount of current flowing to the OLED in response to a voltage on the first node N1, which varies with charge/discharge of the storage capacitor C.

The storage capacitor C is connected between the first node N1 and the second node N2 to which the OLED is connected, in parallel with the driving switching element DT. This storage capacitor C stores a difference voltage between the first and second nodes N1 and N2, and maintains a turned-on state of the driving switching element DT for a predetermined period, for example, one frame period using the stored voltage when the first switching element Ti is turned off.

The OLED has an anode connected to the pixel circuit, a cathode connected to the second power signal VSS, which is a low voltage, and an organic layer formed between the anode and the cathode. This OLED emits light by current from the driving switching element DT through the first switching element T1 of the pixel circuit.

The gate driver 2 sequentially generates gate on signals (for example, gate on voltages of high logic) in response to gate control signals GVS, for example, a gate start pulse (GSP) and a gate shift clock (GSC), from the timing controller 5 and controls the pulse widths of the gate on signals in response to a gate output enable (GOE) signal from the timing controller 5. Then, the gate driver 2 sequentially supplies the gate on signals to the gate lines GL 1 to GLn. Here, gate off signals (for example, gate off voltages of low logic) are supplied to the gate lines GL1 to GLn in a period in which the gate on signals are not supplied to the gate lines GL 1 to GLn.

In particular, the gate driver 2 drives the gate lines GL1 to GLn+1 which are greater in number by one than the total number of horizontal lines, in consideration of a configuration characteristic that sub-pixels on every horizontal line are also connected to a gate line on a next horizontal line. Here, the last gate line GLn+1 may be driven in the same period as the first gate line GL1.

In addition, in consideration of the configuration characteristic that sub-pixels on every horizontal line are also connected to a gate line on a next horizontal line, the gate driver 2 supplies a gate on signal of two horizontal periods to each of the gate lines GL1 to GLn+1 on a horizontal period basis in such a manner that a gate on signal to a gate line on a current horizontal line overlaps with a gate on signal to a gate line on a subsequent horizontal line by one horizontal period.

The data driver 3 converts digital video data Data input from the timing controller 5 into analog voltages, or analog data voltages, using a source start pulse (SSP) and a source shift clock (SSC) among data control signals DVS from the timing controller 5. At this time, the data driver 3 converts the digital video data Data into the analog data voltages using a set of gamma voltages subdivided to correspond respectively to gray scale levels of the digital video data Data. Then, the data driver 3 supplies the data voltages to the respective data lines DL1 to DLm in response to a source output enable (SOE) signal from the timing controller 5. In detail, the data driver 3 latches input digital video data Data based on the SSC, and then supplies data voltages of one horizontal line to the respective data lines DL 1 to DLm in every horizontal period in which a gate on signal is supplied to each gate line GL1 to GLn, in response to the SOE signal.

The timing controller 5 arranges external input video data RGB suitably for the size and resolution of the display panel 1 and supplies the resulting digital video data Data to the data driver 3. In addition, the timing controller 5 generates the gate and data control signals GVS and DVS using external input synchronous signals, for example, a dot clock DCLK, a data enable signal DE, a horizontal synchronous signal Hsync and a vertical synchronous signal Vsync and supplies the generated gate and data control signals GVS and DVS to the gate and data drivers 2 and 3, respectively.

Figure 3:
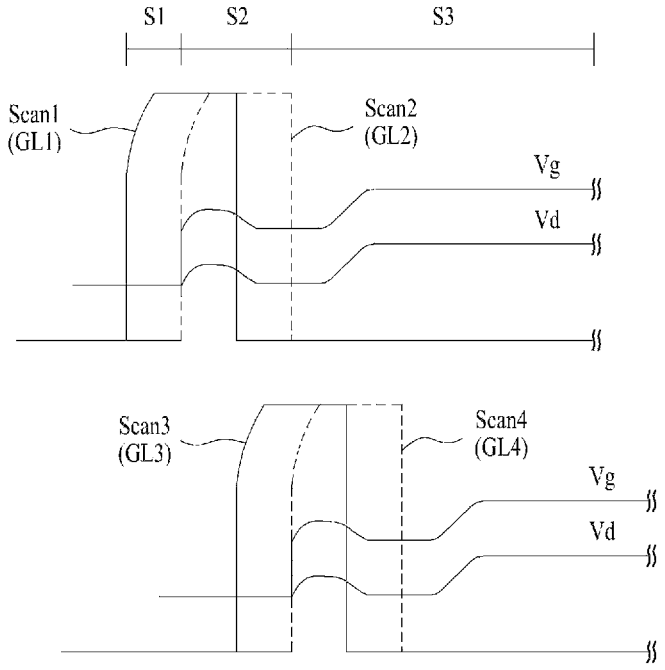
FIG. 3 is a waveform diagram illustrating a method for driving the organic light emitting diode display device according to the embodiment of the present invention.

FIG. 3 is a waveform diagram illustrating a method for driving the OLED display device according to the embodiment of the present invention.

Referring to FIG. 3, a gate on signal of two horizontal periods is supplied to each of the gate lines GL1 to GLn+1 in such a manner that a gate on signal to a gate line on a current horizontal line overlaps with a gate on signal to a gate line on a subsequent horizontal line by one horizontal period.

In this regard, one frame period, namely, a frame period of a unit pixel is divided into a data input period S1, a data charge period S2, and a light emission period S3.

In the data input period S1, a gate on voltage of high logic is supplied to a corresponding gate line GL for two horizontal periods. As a result, the first switching element T1 of each sub-pixel P connected to the gate line GL is turned on for two horizontal periods, thereby causing a data voltage from a corresponding data line DL to be supplied to the first node N1 and the storage capacitor C through the first switching element T1 in the data input period S1, which is one horizontal period.

In the data charge period S2, a gate on voltage of high logic is supplied to a gate line on a next horizontal line for two horizontal periods. As a result, the second switching element T2 is turned on for two horizontal periods by the gate on voltage from the gate line on the next horizontal line to supply the compensation voltage Vref to the second node N2. At this time, the driving switching element DT becomes a forward diode, so that the threshold voltage Vth of the driving switching element DT is sampled at the gate electrode of the driving switching element DT, namely, the first node N1 in the turned-on state of the first switching element T1. Then, when the first switching element T1 is turned off, a difference voltage (VDD-Vth) between the first power signal VDD, which is a high voltage, and the threshold voltage Vth of the driving switching element DT is output because the first power signal VDD is supplied to the source electrode of the driving switching element DT.

Thereafter, in the light emission period S3, the first and second switching elements T1 and T2 are both turned off, and the voltage across the storage capacitor C is kept constant because there is no current path formed in the pixel circuit. Therefore, a voltage variation (Vref-Vdata) at the first node N1 is kept constant and the driving switching element DT is kept on by the gate-source voltage thereof to turn on the OLED.

As described above, in the OLED display device and driving method of the present invention, the pixel circuit of each sub-pixel P can receive a gate on signal from a gate line on a next horizontal line and use the received gate on signal as a sense signal for driving of the driving switching element DT. Therefore, the structure of each sub-pixel P is capable of not only compensating for a video voltage charged in the pixel circuit, but also simplifying the structure of the pixel circuit and a wiring structure. In particular, only one gate line is provided on a horizontal line basis, thereby raising a pixel aperture ratio and further enhancing display quality.

As is apparent from the above description, in an OLED display device and a method for driving the same according to the present invention, the pixel circuit of each sub-pixel can receive a scan signal from a gate line on a next horizontal line and use the received scan signal as a sense signal. Therefore, it is possible not only to compensate for a video voltage charged in the pixel circuit, but also to simplify the structure of the pixel circuit and a wiring structure. In particular, only one gate line is provided on a horizontal line basis, thereby raising a pixel aperture ratio and further enhancing display quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display device comprising:

a display panel having a plurality of sub-pixels wherein the sub-pixels on each horizontal line are connected to a gate line on the same horizontal line and are further connected to a gate line on a next horizontal line to further receive a gate on signal from the gate line on the next horizontal line so as to display an image;

a gate driver for driving the gate lines of the display panel;

a data driver for driving data lines of the display panel;

a power supply for supplying first and second power signals to power lines of the display panel and supplying a compensation voltage to a compensation power line of the display panel; and a timing controller for arranging external input video data for driving of the display panel and supplying the arranged video data to the data driver, and controlling the gate and data drivers such that the image is displayed based on a data voltage compensated for by the compensation voltage, wherein each of the plurality of sub-pixels comprises:

a first switching element for supplying a data signal from a corresponding one of the data lines to a first node in response to a gate on signal from the gate line on the same horizontal line to charge a storage capacitor;

a second switching element for supplying the compensation voltage supplied through the compensation power line to a second node in response to the gate on signal from the gate line on the next horizontal line; and a driving switching element for controlling the amount of current flowing to an organic light emitting diode in response to a voltage on the first node, the organic light emitting diode being connected to the second node, the voltage on the first node varying with charge/discharge of the storage capacitor, wherein the storage capacitor is connected between the first node and the second node in parallel with the driving switching element to store a difference voltage between the first and second nodes and maintain a turned-on state of the driving switching element using the stored voltage when the first switching element is turned off, wherein the gate line on the next horizontal line is connected to first switching elements of the sub-pixels on the next horizontal line, and wherein a last one of the gate lines is driven in the same period as a first one of the gate lines.

2. The organic light emitting diode display device according to claim 1, wherein the gate driver drives gate lines of a number greater by one than a total number of horizontal lines.

3. The organic light emitting diode display device according to claim 2, wherein the gate driver supplies a gate on signal of two horizontal periods to each of the gate lines on a horizontal period basis in such a manner that a gate on signal to a gate line on a current horizontal line overlaps with a gate on signal to a gate line on a subsequent horizontal line by one horizontal period.

4. The organic light emitting diode display device according to claim 3, wherein:

the first switching element is turned on for two horizontal periods to supply a data voltage from the corresponding data line to the first node and the storage capacitor in a data input period, the data input period being one horizontal period;

the second switching element is turned on for two horizontal periods by a gate on voltage from the gate line on the next horizontal line to supply the compensation voltage to the second node; and the first and second switching elements are both turned off in a light emission period to keep a voltage across the storage capacitor constant and, in turn, to keep a voltage variation at the first node constant to keep the driving switching element on so as to turn on the organic light emitting diode.

5. A method for driving an organic light emitting diode display device, the organic light emitting diode display device comprising a display panel having a plurality of sub-pixels, wherein the sub-pixels formed on each horizontal line are connected to a gate line on the same horizontal line and are further connected to a gate line on a next horizontal line to further receive a gate on signal from the gate line on the next horizontal line so as to display an image, wherein each of the plurality of sub-pixels comprises:

a first switching element for supplying a data signal from a corresponding one of the data lines to a first node in response to a gate on signal from the gate line on the same horizontal line to charge a storage capacitor;

a second switching element for supplying the compensation voltage supplied through the compensation power line to a second node in response to the gate on signal from the gate line on the next horizontal line; and a driving switching element for controlling the amount of current flowing to an organic light emitting diode in response to a voltage on the first node, the organic light emitting diode being connected to the second node, the voltage on the first node varying with charge/discharge of the storage capacitor, wherein the storage capacitor is connected between the first node and the second node in parallel with the driving switching element to store a difference voltage between the first and second nodes and maintain a turned-on state of the driving switching element using the stored voltage when the first switching element is turned off, and wherein the gate line on the next horizontal line is connected to first switching elements of the sub-pixels on the next horizontal line, the method comprising:

driving the gate lines of the display panel;

driving data lines of the display panel;

supplying first and second power signals to power lines of the display panel and supplying a compensation voltage to a compensation power line of the display panel; and arranging external input video data for driving of the display panel and controlling gate and data drivers such that the image is displayed based on a data voltage compensated for by the compensation voltage, wherein a last one of the gate lines is driven in the same period as a first one of the gate lines.

6. The method according to claim 5, wherein the driving the gate lines comprises driving gate lines of a number greater by one than a total number of horizontal lines.

7. The method according to claim 6, wherein the driving the gate lines comprises supplying a gate on signal of two horizontal periods to each of the gate lines on a horizontal period basis in such a manner that a gate on signal to a gate line on a current horizontal line overlaps with a gate on signal to a gate line on a subsequent horizontal line by one horizontal period.

8. The method according to claim 7, wherein:

the first switching element is turned on for two horizontal periods to supply a data voltage from the corresponding data line to the first node and the storage capacitor in a data input period, the data input period being one horizontal period;

the second switching element is turned on for two horizontal periods by a gate on voltage from the gate line on the next horizontal line to supply the compensation voltage to the second node; and the first and second switching elements are both turned off in a light emission period to keep a voltage across the storage capacitor constant and, in turn, to keep a voltage variation at the first node constant to keep the driving switching element on so as to turn on the organic light emitting diode.

* * * * *